US010571106B2

(12) United States Patent
Goerts

(10) Patent No.: US 10,571,106 B2
(45) Date of Patent: Feb. 25, 2020

(54) CABLE ENTRY FOR OUTDOOR LED MODULE

(71) Applicant: SIGNIFY HOLDING B.V., Eindhoven (NL)

(72) Inventor: Walter Johannes Marie Goerts, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/760,240

(22) PCT Filed: Sep. 15, 2016

(86) PCT No.: PCT/EP2016/071871

§ 371 (c)(1),
(2) Date: Mar. 15, 2018

(87) PCT Pub. No.: WO2017/055100

PCT Pub. Date: Apr. 6, 2017

(65) Prior Publication Data

US 2018/0252400 A1 Sep. 6, 2018

(30) Foreign Application Priority Data

Sep. 30, 2015 (EP) ..... 15187703

(51) Int. Cl.
*F21V 27/02* (2006.01)
*H01R 13/58* (2006.01)
(Continued)

(52) U.S. Cl.
CPC ..... *F21V 27/02* (2013.01); *H01R 13/58* (2013.01); *F21V 23/003* (2013.01); *F21Y 2115/10* (2016.08)

(58) Field of Classification Search
USPC ..... 362/391
See application file for complete search history.

(56) References Cited

U.S. PATENT DOCUMENTS 4,118,760 A 10/1978 Cohon
4,981,444 A 1/1991 Willmott
2009/0027901 A1* 1/2009 Wang ..... F21V 15/01 362/374

FOREIGN PATENT DOCUMENTS

CN 101749663 A 6/2010
CN 101929664 A 12/2010
(Continued)

*Primary Examiner* — Elmito Breval
(74) *Attorney, Agent, or Firm* — Daniel J. Piotrowski

(57) ABSTRACT

The invention provides a multi-part cable module (10) for association with a receiver rail element (350) of a support (30), the multi-part cable module (10) comprising a primary part (100) and a secondary part (200), wherein the primary part (100) is configured to engagingly receive the secondary part (200), wherein the primary part (100) comprises a) a cavity (110) to receive at least part of the secondary part (200), and b) a primary part opening (120) to provide access to at least part of a functional part (210) of the secondary part (200) when the secondary part (200) is engagingly received by the primary part (100), and wherein the primary part (100) further comprises c) a primary part rail element (150) configured for a male-female association with the receiver rail element (350) of the support (30); the secondary part (200) comprises (a) an inlet (220) for receiving a cable (410), and (b) said functional part (210), wherein the functional part comprises an outlet (230) for said cable (410).

14 Claims, 5 Drawing Sheets

(51) Int. Cl.
*F21V 23/00* (2015.01)
*F21Y 115/10* (2016.01)

(56) References Cited

FOREIGN PATENT DOCUMENTS

| | | | |
|---|---|---|---|
| CN | 203454074 | U | 2/2014 |
| EP | 1248320 | A2 | 10/2002 |
| EP | 1617137 | A1 | 1/2006 |
| EP | 2497998 | A2 | 9/2012 |
| EP | 2819252 | A1 | 12/2014 |
| GB | 942502 | A | 11/1963 |

* cited by examiner

CABLE ENTRY FOR OUTDOOR LED MODULE

CROSS-REFERENCE TO PRIOR APPLICATIONS

This application is the U.S. National Phase application under 35 U.S.C. § 371 of International Application No. PCT/EP2016/071871, filed on Sep. 15, 2016 which claims the benefit of European Patent Application No. 15187703.2 filed on Sep. 30, 2015. These applications are hereby incorporated by reference herein.

FIELD OF THE INVENTION

The invention relates to a multi-part cable module, a kit of parts comprising such multi part cable module, as well as to a method for providing a lighting device including such multi-part cable module. The invention further relates to such lighting device per se.

BACKGROUND OF THE INVENTION

Lighting modules with passages for power supply cables are known in the art. EP2497998, for instance, describes a light emitting diode (LED) module which includes a substrate on which an LED is mounted; a heat radiation unit configured to include an insertion hole for passage of a power supply cable that supplies power to the substrate; a lens plate configured to include a lens corresponding to the LED and to cover the substrate; a rubber seal configured to be disposed between the heat radiation unit and the lens plate; and a waterproof structure configured to be inserted in the insertion hole and to include a through hole to receive the power supply cable, wherein the substrate is received in an inner space constructed as the lens plate, the rubber seal, and the heat radiation unit are connected, and the inner space has a waterproof structure.

SUMMARY OF THE INVENTION

A good closure of lighting devices is important to prevent getting e.g. water and/or dust into the lighting device, which may reduce lifetime and/or performance during the (remaining) lifetime. In the art, solutions are proposed that may suffer from one or more of not being water tight, not being able to withstand strain on a cable (especially in a direction parallel to the a cable axis), not easily integrable in existing lighting devices (herein also indicated as "luminaires"), and not being easily integrable in existing lighting device construction or application processes.

Hence, it is an aspect of the invention to provide an alternative solution for cable entry in (lighting) devices, which preferably further at least partly obviates one or more of above-described drawbacks.

In a first aspect, the invention provides a multi-part cable module (herein also indicated as "module" or "two-part module") for association with a receiver rail element of a support, the multi-part cable module comprising a primary part and a secondary part, wherein the primary part is configured to engagingly receive the secondary part, wherein the primary part comprises (a) a cavity to receive at least part of the secondary part, and (b) a primary part opening to provide access to at least part of a functional part of the secondary part (from a first primary part side of the primary part) when the secondary part is (configured) engagingly received by the primary part, and wherein the primary part further comprises (c) a primary part rail element configured for a male-female association with the receiver rail element of the support;

the secondary part comprises (a) an inlet ("cable inlet") for receiving a cable, and (b) said functional part, wherein the functional part comprises an outlet ("cable outlet") for said cable, wherein the functional part further comprises a gasket perimetrically surrounding said outlet, and wherein the secondary part and gasket are an injection molding product.

With such multi-part cable module it is possible to provide both a good strain relief and protection from (rain) water external from the device. Especially, the multi-part cable module allows an IP55 or higher, such as IP65 or higher, especially IP66 protection or higher. IP (or "Ingress Protection") ratings are defined in international standard EN 60529 (British BS EN 60529:1992, European IEC 60509: 1989). They are used to define levels of sealing effectiveness of electrical enclosures against intrusion from foreign bodies (tools, dirt etc.) and moisture. IP55 indicates that the device is protected from limited dust ingress and protected from low pressure water jets from any direction. IP65 indicates that the device is protected from total dust ingress and protected from low pressure water jets from any direction. IP66 indicates that the device is totally dust tight and that the device is protected against string water jets and waves (protected from high pressure water jets from any direction). With the present invention, the part of the device where a cable enters the device can be closed to such an extent, that IP66 or higher may be obtained. Here, the high ingress protection of the device is especially related to the cable entry solution herein provided. Hence, the invention provides a cable entry with high ingress protection and strain relief, especially for outdoor lighting devices (see also below).

The multi-part cable module is especially useful in combination with a specific support, especially a specific support for application in a lighting device ("lighting module"). The multi-part cable module is herein also explained in relation to such support, as the multi-part cable module is configured to be able to be associated with the support in a male-female association, wherein especially the multi-part cable module cannot move relative to the support in a direction parallel to the support and/or a direction perpendicular to the support, at least not without a delocking action.

Further, the multi-part cable module is especially useful in combination with a cable, especially an electric cable. The multi-part cable module is also explained in relation to the cable, as the multi-part cable module is configured to have at least part of the cable enclosed by the multi-part cable module, especially attached to the multi-part cable module, wherein especially the cable within the multi-part cable module cannot move relative to the multi-part cable module in a direction parallel to a cable axis, and may even not be able to rotate within the multi-part cable module (especially assuming a cable having a substantially circular cross-section), at least not without a delocking action (of delocking the cable from the multi-part cable module).

However, the cable is not necessarily part of the multi-part cable module and the support is (also) not part of the multi-part cable module.

The term "multi-part cable module" includes the term "multi-part". The multi-part cable module especially at least two elements, of which one element, the "primary part" is especially configured to be slided in or along a receiver rail element of the support and of which the other element, the "secondary part", is especially configured to be received by the primary part, wherein the action of introducing the secondary part into the primary part may be indicated with a vector having at least a component perpendicular to a vector describing the sliding action of the primary part on or into the receiver rail element of support. The sliding direction is especially parallel to the rail elements. In embodiments, the multi-part cable module is a two-part cable module (a two-part module for enclosing at least part of the cable).

Further, the term "multi-part cable module" refers to a module suitable for receiving a cable, especially an electrical cable. In embodiments, the cable, or at least part thereof, may be integrated in the multi-part cable module (see also below). However, as indicated above the cable is not necessarily part of the multi-part cable module. The cable especially comprises an electrical cable (including insulation). The term "cable" may in embodiments also refer to a plurality of cables. Optionally, the term cable may refer to a conduit, or a glass fiber cable, or another type of data cable. The term cable especially refers to a flexible cable as the cable inlet and cable outlet of the secondary part are especially comprised by different sides of the secondary part.

The primary part is especially configured to engagingly receive the secondary part. Hence, at least part of the secondary part, or especially substantially the entire secondary part, may be incorporated into the primary part. This may e.g. be done by a translational or rotational movement (see also below). To this end, the primary part especially comprises (a) a cavity to receive at least part of the secondary part. Hence, the cavity is especially configured to host at least part, or substantially the entire secondary part. Optionally, the primary part may be configured to engagingly receive a plurality of secondary parts. Herein, the invention is further explained with reference to a primary part configured to receive a single secondary part.

The primary part further comprises (c) a primary part rail element configured for a male-female association with the receiver rail element of the support. Hence, the secondary part may slide over the receiver rail element or may slide in between two rail elements. The term "rail element" may thus also relate to a plurality, such as two, especially parallel arranged, rail elements. This may apply to the primary part rail element and/or the receiver rail element. Hence, especially via a translational movement, the primary part may at least partially be integrated into the support. In this way, a male-female association may be created which may substantially block a movement in a direction perpendicular to a body axis of the primary part. Amongst others, in this way strain relief may be obtained. The body axis of the primary part is especially configured parallel to the primary part rail element(s).

The primary part may have an elongated shape. For instance, the primary part may have a bar like shape with at the longer edges primary part rail elements. An edge of the primary part may have an opening (for receipt of the cable which extends from the cable inlet).

The secondary part especially comprises (a) an inlet for receiving a cable, and a functional part, wherein the functional part comprises an outlet for said cable. Hence, when the cable is arranged through the secondary part (especially entering at an edge and leaving the secondary part at a first secondary part side), especially a part of the cable may extend from the inlet (e.g. to a source of power, especially electrical power), and especially a part of the cable may extend from the outlet (e.g. to the light source, to provide power from an external electrical power source to the light source). Hence, when following the arrangement of the cable in operation, the cable enters the secondary part via the inlet (at an edge), exits from the secondary part at the functional part (at the first secondary part side) and enters the support via (the primary part opening and) the support opening of the support (see also below). Note that the terms "inlet", "outlet" and "cable" may also refer to a plurality of inlet, outlets or cables, respectively. The edge with cable inlet of the secondary part and first secondary part side with functional element and cable outlet may especially be configured perpendicular to each other. This allows a relatively thin multi-part cable module.

The secondary part may have an elongated shape. For instance, the secondary part may have a bar like shape, substantially fitting in an (elongated cavity) of the primary part.

The term "functional part" is used as this part may be the part that provides the cable to the support (and the rest of the (lighting) device). Further, the functional part may be used to block a translational movement of the multi-part cable module relative to the support. For instance, at least part of the functional part may extend into the support via a support opening (see further below). In such embodiments, substantially only a translation perpendicular to the support opening would be possible; however such translation may effectively be blocked by an anchoring of the secondary part in the primary part (see also below). In embodiments, the term "functional part" may also refer to a plurality of functional parts. In such embodiments, the related support will especially also comprise a plurality of support openings.

The primary part is configured such that when the secondary part is (configured) engagingly received by the primary part, the functional part of the secondary part is accessible. An embodiment to obtain such configuration is a primary part comprising a body with a through cavity or a frame-like primary part. Such primary part allow introduction of the secondary part (via a second primary part side) into the primary part and access to the functional part (at or via the first primary part side). Hence, the primary part especially comprises also a primary part opening to provide access to at least part of a functional part of the secondary part (from a first primary part side of the primary part) when the secondary part is engagingly received by the primary part.

Hence, in a stage wherein the multi-part cable module is associated with the support, the secondary part is (configured) engagingly received by the primary part and the multi-part cable module is (configured) associated with the support in a male-female association (via the rail elements). Thereby, translation of the cable in different directions (and rotation) may effectively be blocked. Further, the inlet and/or outlet allow closures of devices with a high ingress protection.

The functional part further comprises a gasket perimetrically surrounding said outlet. A gasket is especially a mechanical seal which fills the space between two or more mating surfaces, generally to prevent leakage from or into the joined objects while under compression. When the multi-part cable module is associated with the support, the gasket may touch the support opening. The gasket may especially comprise a material that can partly be compressed. Hence, the gasket may be pressed into the support opening. The gasket is especially configured to function as gasket for the outlet of the secondary part and the support opening. When the multi-part cable module is associated with the support, the gasket may at least partly extend into the support (via the support opening). Alternatively, the gasket may be associated with the support opening.

The secondary part and gasket are an injection molding product, preferably a plastic or a two-component injection molding product. Examples of materials that might be used for two-component injection molding may e.g. include silicone material for the gasket. Optionally, the cable outlet part of the cable and part of the functional element may be overmolded.

The multi-part cable module may comprise in the secondary part a duct for passing through the cable, said duct comprising a curvature, said curvature having an angle ß in the range of 45° to 180°, preferably from 60° to 120°. This curvature anchors the cable in the duct, and counteracts slipping of the cable inside the duct when the cable is pulled at one end. For a good strain relief, especially the cable may be anchored in the multi-part cable module. To this end, the cable and/or the multi-part cable module may include means to anchor the cable, such as resilient members, click-stop connections, etc. etc. Alternatively or additionally, the cable (especially isolation of an electrical cable) and the multi-part cable module may be bound to each other, e.g. by a weld. Hence, in embodiments the cable is configured anchored in the multi-part cable module. In such embodiments, the cable, or at least part thereof, is part of the multi-part cable module. In yet further embodiments at least part of the cable is integrated in the secondary part. Especially, at the inlet of the secondary part, the cable and the secondary part comprise an overmolding. In particular slipping is counteracted when the cable snugly fits in the duct, or is presence in the duct under permanent compressive force. Said snugly fit (under permanent compressive force) is relatively easily obtainable by injection molding and/or overmolding. Overmolding techniques are known in the art. They may provide a strong and reliable anchoring of the cable in the multi-part cable module (i.e. especially the cable and the secondary part). As indicated above, especially the cable comprises an electrical cable.

The primary part and the secondary part may be provided as separate non-connected items. Hence, the invention also provides a primary part per se and a secondary part per se, each suitable for use in the multi-part cable module as defined herein. Especially however, in embodiments the primary part and secondary part are hingingly coupled with a coupling, such as a hinge; especially the hinge comprises a film hinge. Instead of the film hinge, also other couplings (or hinges) may be applied, such as a rotational connection.

The multi-part cable module may further comprise a body axis. Especially, the body axis is configured parallel to the primary part rail element(s). Several measures may be taken to prevent the secondary part being easily removed from the primary part. Hence, in embodiments the primary part and secondary part are configured such that when the secondary part is (configured) engagingly received by the primary part, the secondary part cannot move relative to the primary part, such as parallel or perpendicular, especially perpendicular, to the body axis (when defined relative to the primary part). Especially, in embodiments the primary part and the secondary part comprise (first) click-stop elements for a click-stop connection when the secondary part is engagingly received by the primary part. In this way, the secondary part may be anchored in the primary part. For instance, the primary part may include a stop element and the secondary part may include a (corresponding) click element; alternatively, the primary part may include a click element and the secondary part may include a (corresponding) stop element. Other anchoring means (known in the art) may also be used. Hence, when arranging the secondary part into the primary part a certain position the first click-stop elements may provide a configuration wherein the secondary part may not be able to get out the primary part or penetrate further into the primary part (cavity).

As indicated above, the functional part may be used to block a translational movement of the multi-part cable module relative to the support. For instance, at least part of the functional part may extend into the support, or extend beyond the support, or extend into the lighting device, via the support opening. Therefore, in embodiments the primary part comprises said first primary part side, wherein the secondary part comprises a first secondary part side, wherein at least part of the functional part extends from said first secondary part side, and wherein at least part of the functional part is configured to extend also from the first primary part side when the secondary part is (configured) engagingly received by the primary part. Other measures may also (additionally) be possible, such as with stop elements and/or click-stop connections (see also below). Note however that the configuration of the rail elements, and thereby the herein described male-female association of the multi-part cable module and the support, in combination with the anchoring of the secondary part in the primary part may already provide the desired lack of translational freedom. The rail elements substantially block a translation perpendicular to a rail axis (body axis), and the functional part extending into the support substantially blocks a translation parallel to the rail axis (body axis).

The support especially comprises a receiver rail element, for providing together with the primary part rail element the male-female association. These rail elements are especially configured such, that when one slides in or over the other, only a translational movement along a rail axis is possible, and substantially no translational movement perpendicular to such axis is possible. In an embodiment, the primary part rail element is configured to be at least partly enclosed by the receiver rail element. In yet other embodiments, the receiver rail element is configured to be at least partly enclosed by the primary part rail element. Especially, both the support and the primary part comprise at both sides rail elements. Amongst others in this way two male-female connections may be made which are especially configured in mirror symmetry. This allows a sliding movement (along the rail elements), but substantially prevents a translational movement perpendicular to the sliding movement. Hence, especially the primary part comprises a set of at least two parallel arranged primary part rail elements (especially thus also parallel to the body axis of the multi-part cable module). Further, especially also the support comprises a set of at least two parallel arranged receiver rail elements. The primary part rail elements of the primary part/multi-part cable module and the receiver rail elements of the support are configured such that a male-female association is possible. The term "male-female association" may also refer to a plurality of such associations. The primary part rail elements of the primary part/multi-part cable module and the receiver rail elements of the support are therefore especially configured such, that when the primary part/multi-part cable module and the support are associated, essentially only a translational movement along a rail axis (body axis) could be possible (but see herein the additional means to prevent this when the multi-part cable module and support are configured associated).

The support may be provided as support in combination with one or more light sources, such as a printed circuit board PCB with one or more light sources, especially light emitting diodes. For instance, the PCB may be attached to the support. The support further comprises a support opening, for receiving the cable, and especially also for receiving at least part of the functional element. The cable, when being an electrical cable, may be functionally coupled to the light source(s), such via an electrically conductive coupling with the PCB.

Further, the support may be configured as heat sink. Hence, the support may be thermally coupled with the PCB and/or light source(s).

The multi-part cable module and support are especially configured for each other, such that a male-female association is possible (like a plug and a socket). Hence, in a further aspect the invention also provides a kit of parts comprising (a) a support comprising a rail element and (b) the multi-part cable module according to any one of the preceding claims, wherein the multi-part cable module and support are associable in a male-female association by said primary part rail element of the primary part and said receiver rail element of the support; and the support further comprises a support opening to provide access to at least part of said functional part of the secondary part (from a first support side of the support) when the secondary part is (configured) engagingly received by the primary part.

Such kit of parts allows providing an intimate association of the multi-part cable module and support, such that a IP66 connection may be provided. The phrase "the multi-part cable module and support are associable in a male-female association" especially indicates that the multi-part cable module and support can be configured in a male-female association (can be configured associated). The male-female association(s) is (are) especially provided by the male-female arrangement(s) of the rail element(s) of the multi-part cable module and the rail element(s) of the support, The kit of parts may not only include the support, but may also include other items that may especially be used for assembling a lighting device. Hence, in embodiments the kit of parts may further comprise a light source and a closure, for functionally coupling with said support to provide a lighting device, wherein the light source especially comprises a light emitting diode (LED). The terms "light source" and "light emitting diode" may also refer to a plurality of light sources or light emitting diodes, respectively. Further, the light source may be provided on a PCB, which may be associated with at least part of the support. For providing a good closure, also complying with e.g. at least IP55, especially at least IP66, the kit of parts may further comprise e.g. one or more gaskets, for providing a seal between e.g. the closure and the support, etc. The closure especially comprises a part that is transmissive for light of the light source; or substantially the entire closure may be transmissive for light of the light source. The closure may include a lens element. The closure may e.g. be a molded or extruded part (of light transmissive material).

As indicated above, the multi-part cable module and support may be configured such that the multi-part cable module cannot move when associated with the support, especially not along a rail axis. Hence, in yet further embodiments (a) one or more of the primary part and the secondary part and (b) the support comprise second click-stop elements for a click-stop connection when the multi-part cable module and support are (configured) associated in the male-female association. Hence, when sliding the primary part along the receiver rail element at a certain position the click-stop elements may provide a configuration wherein the primary part may not be able to slide further or to slide back. For instance, one or more of the primary part and the secondary part may include a stop element and the support may include a (corresponding) click element; alternatively, one or more of the primary part and the secondary part may include a click element and the support may include a (corresponding) stop element. In embodiments, the click-stop elements may be comprised by the rail elements. The receiver rail element and the primary part rail element further substantially block a movement in a direction perpendicular to a rail axis (i.e. an axis parallel to the sliding direction). In this way, the strain relief may (further) be obtained. With respect to the male-female association of the support and the multi-part cable module, a stop element at the primary part rail element(s) and/or at the receiver rail element(s) may also suffice. The phrase "male-female association of the support and the multi-part cable module" and similar phrases, may especially relate to a male-female configuration of the primary part rail element(s) and the receiver rail element(s).

In yet further aspects, the invention provides also a method for providing a lighting device comprising:

providing (a) a light source functionally coupled to a support, (b) a closure, and (c) a multi-part cable module as defined herein with an electrical cable; wherein said support comprises a receiver rail element and a support opening to provide access to at least part of said functional part of the secondary part (from a first support side of the support) when the secondary part is (configured) engagingly received by the primary part; and executing the following actions:

(i) configuring the primary part rail element with the receiver rail element of the support into a male-female association, and arranging at least part of the secondary part into the cavity of the primary part such that the secondary part is engagingly received by the primary part;

(ii) functionally coupling the light source with the electrical cable; and (iii) functionally coupling the support and the closure to enclose at least part of the light source.

Note that dependent upon the device, and optionally also dependent upon the chosen embodiments, different orders of (i)-(iii) may be applied. For instance, it may be possible in embodiments to first functionally couple the light source with the electrical cable and then execute action (i). It might even be possible that the cable is already associated with the light source, and has to be connected with the multi-part cable module, which thereafter is brought into a male-female association. Especially however, the electrical cable, or at least part thereof, is associated with the multi-part cable module. After configuring the multi-part cable module in a male-female configuration with the support, the light source may functionally be coupled to the cable. The invention also provides the lighting device obtainable with such method.

In yet a further aspect, the invention also provides a lighting device comprising (a) a light source functionally coupled to a support and (b) a closure, wherein the lighting device further comprises a multi-part cable module as defined herein with an electrical cable, wherein:

the closure encloses at least part of the light source;

said support comprises a receiver rail element and a support opening to provide access to at least part of said functional part of the secondary part (from a first support side of the support);

the primary part rail element is (configured) associated with the receiver rail element of the support into a male-female association; and the secondary part is (configured) engagingly received by the primary part.

As indicated above, the multi-part cable module may essentially not be able to move relative to the support in the associated state. To this end, in embodiments at least part of the functional part extends from the first secondary part side into the support opening, and may even extend over the support face (i.e. first support side). The support opening and functional part may substantially have the same dimensions, thereby allowing a tight fit. The gasket may add to this tight fit (and also to the high protection against particle and/or water ingress).

Further, all embodiments described above in relation to the multi-part cable module and the kit, as well as the method, may also relate to the lighting device per se.

Hence, the invention especially provides in yet a further aspect the use of a multi-part cable module as defined herein for providing a lighting device with high ingress protection, such as IP55 or higher, especially IP65 or higher, such as even more especially IP66 or higher.

The lighting device may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, green house lighting systems, horticulture lighting, or LCD backlighting. Especially, the lighting device may be used for outdoor lighting. The lighting device may be part of an outdoor lighting system.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

DETAILED DESCRIPTION OF THE EMBODIMENTS

For new outdoor LED module used for road lighting, a module is needed which is easy to install for the OEM market. Especially, a complete module with all functionality together in one module: light beam for road lighting; ingress protection, especially IP66; thermal performance and ease of installation in the luminaires. Such module may be built from several main parts:

Lens plate for light beam which can cover the electronics of the PCB.

Gaskets to close the openings on the module for:

the closing function between lens plate and base plate the power cable entry of the module connected to the PCBA.

PCBA with LED's for light source

Base plate to mount on the luminaire.

This invention provides a cable entry with an IP66 rating and strain relief.

The present invention can be used in outdoor modules. Below, some parts that may be used in the solution are listed:

1. plastic part with sliding function (primary part)
2. plastic part with a rotation function (secondary part)
3. over molded power cable's with a gasket function
4. gasket Part 1 and 2 can integrated with e.g. film hinges; with 2K-molding options the gasket and wires (3 & 4) can also integrated, respectively. Especially, the cable is integrated in the primary part, including an overmolding of at least part of the primary part and at least part of the cable, to provide a high ingress protection. Hence, especially the cable is overmolded into the secondary part. Further, a base plate from the LED module with special cut out is used.

Figure 1:
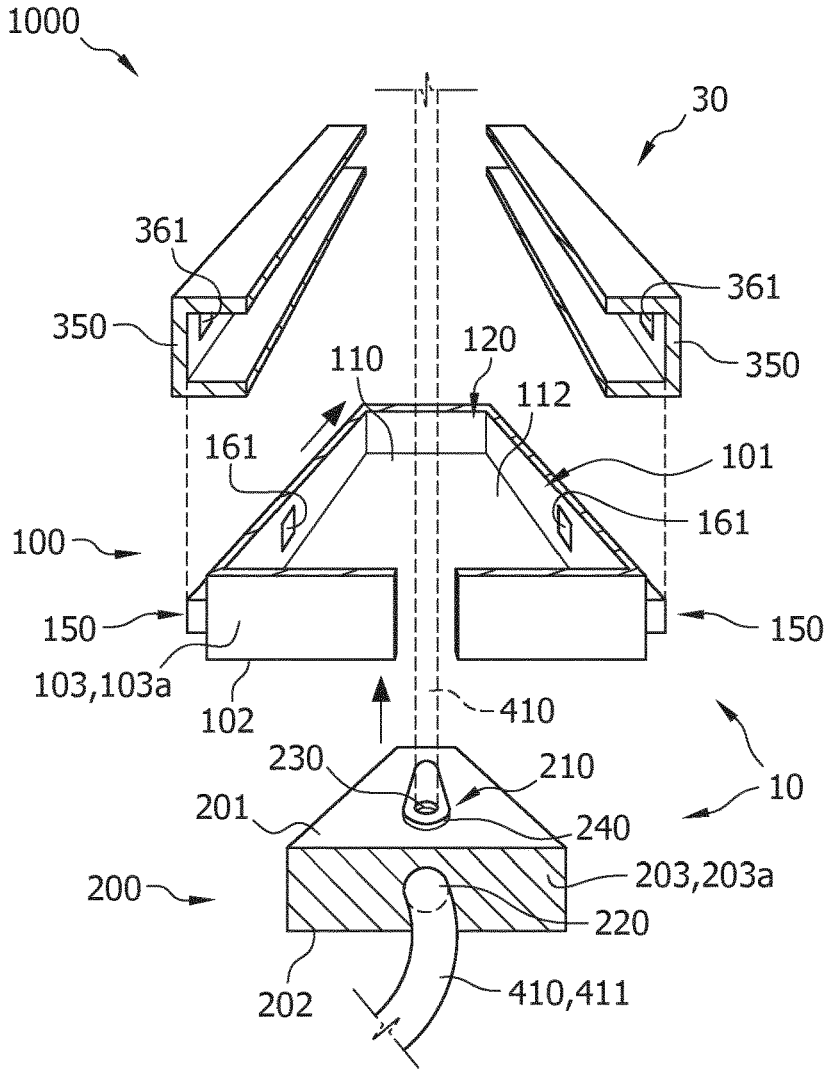
FIG. 1 very schematically depicts an embodiment of the kit of parts as well as of the multi-part cable module.

FIG. 1 schematically depicts a multi-part cable module 10 for association with a receiver rail element 350 of a support 30. The support 30 is very schematically depicted, with essentially only the rail element(s) 350, for the sake of clarity. For further details with respect to the support 30, it is also referred to FIGS. 3*a* and 3*b*.

The multi-part cable module 10 comprises a primary part 100 and a secondary part 200. The primary part 100 is configured to engagingly receive the secondary part 200.

The primary part 100 comprises a cavity 110 to receive at least part of the secondary part 200, and a primary part opening 120 (at a first primary part side 101) to provide access to at least part of a functional part 210 of the secondary part 200 from a first primary part side 101 of the primary part 100 when the secondary part 200 is engagingly received by the primary part 100. The cavity 110 comprises a cavity opening at a second primary part side 102 (opposite of the first primary part side 101) of the primary part 100. Further, the primary part 100 includes an edge 103, with reference 103*a* indicating (an) end edge(s) and reference 103*b* (see FIG. 2*b*) indicating (a) side edge(s). Here, the primary part 100 is substantially a hollow frame. Part of the primary part may also be configured for access of at least the cable 410. Hence, in the embodiment schematically depicted in FIGS. 1 and 3*a*, the primary part has an opening at the edge (for receipt of the cable), here end edge 103*a*. In this way, the primary part 100 also provides space for the cable 410 at the cable inlet 220 at the edge 203*a*. Other embodiments may also be possible.

The primary part 100 further comprises a primary part rail element 150 configured for a male-female association with the receiver rail element 350 of the support 30.

The secondary part 200 comprises an inlet 220 for receiving a cable 410, and said functional part 210, wherein the functional part comprises an outlet 230 for said cable 410. The secondary part 200 comprise a first secondary part side 201 and (opposite thereof) a second secondary part side 202. Further, the secondary part 200 includes an edge 203, with reference 203*a* indicating (an) end edge(s) and reference 203*b* (see FIGS. 2*a*-2*b*) indicating (a) side edge(s).

Hence, FIG. 1 also schematically depicts a kit of parts 1000 comprising the support 30 comprising a rail element 350 and the multi-part cable module 10 according to any one of the preceding claims. As is shown in the graph, the multi-part cable module 10 and support 30 are associable in a male-female association by said primary part rail element 150 of the primary part 100 and said receiver rail element 350 of the support 30. Yet further, the support 30 further comprises a support opening (not depicted) to provide access to at least part of said functional part 210 of the secondary part 200 (from a first support side 301 of the support 30) when the secondary part 200 is engagingly received by the primary part 100.

A way of configuring in a male-female association the multi-part cable module 10 to the support 30 is indicated with the arrows. The primary part 100 is slided to the support 30 and the secondary part 200 is arranged to the primary part 100. To this end, the primary part comprises here a through cavity 100, with at the top or the first primary part side 101 an opening. Through this opening 101, the functional part 210 may at least partly extend into the support 30. The functional part 210 may further also at least partly extend into and through the support opening (not depicted).

As can be derived from FIG. 1, the rail elements 150, 350 are configured to provide two male-female connections, which are configured in mirror symmetry. This allows a sliding movement (along the rail elements 150,350), but substantially prevents a translational movement perpendicular to the sliding movement.

A cable is indicated with dashes; the cable is indicated with reference 410. Reference 411 indicates an electrical cable.

The secondary part 200 may further be anchored in the primary part with click-stop elements. Embodiments of the click-stop elements associated with the primary part are schematically indicated in FIG. 1, indicated with reference 161, this may e.g. be a click element (of first stop-click elements). The click-stop elements that anchor the secondary part 200 to the primary part 100 are herein also indicated as first click-stop elements.

Likewise, the primary part 100 may further be anchored in the support 30 with click-stop elements. Embodiments of the click-stop elements associated with the support 30 are also schematically indicated in FIG. 1. The click-stop elements that anchor the primary part 100 to the support 30 are herein also indicated as second click-stop elements. Alternatively or additionally to the second click-stop elements, the support 30 or the multi-part cable module 10, especially one or more of their rail elements may include a stop element (see also FIG. 3*a*).

References 201 and 202 indicate a first side and a second side of the secondary part 200, respectively. At least part of the functional part 210 extends from said first secondary part side 201. Further, as indicated above at least part of the functional part 210 is configured to extend also from the first primary part side 101 when the secondary part 200 is engagingly received by the primary part 100.

Reference 12 indicates a body axis of the multi-part cable module 10. The primary part 100 and secondary part 200 are configured such that when the secondary part 200 is engagingly received by the primary part 100, the secondary part 200 cannot move parallel to the body axis 12.

FIG. 1 also shows that the functional part 210 further comprises a gasket 240 perimetrically surrounding said outlet 230. Optionally, the gasket 240 is not comprised by the functional part 210 but by the primary support 30. Further, optionally also part of the functional part 210 and the cable 410 at the outlet 230 are overmolded (not depicted).

The primary part 100 may have an elongated shape. For instance, the primary part 100 may have a bar like shape with at the longer edges primary part rail elements 150.

The secondary part 200 may have an elongated shape. For instance, the secondary part 200 may have a bar like shape, substantially fitting in an (elongated) cavity 110 of the primary part 100. The edge with inlet 220 of the secondary part 200 and the first secondary part side 201 may especially be configured perpendicular to each other.

Figure 2A:
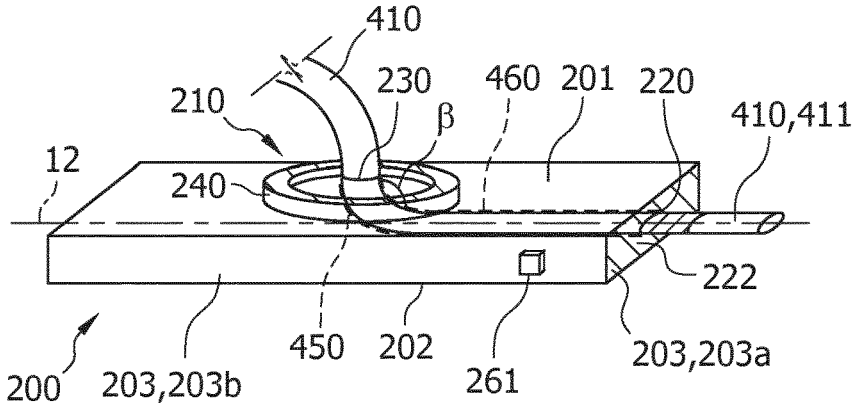
FIGS. 2*a*-2*c* schematically depict some aspects and variants.

FIG. 2*a* schematically depicts in more detail an embodiment of the primary part 200, here with the cable 410 integrated into the secondary part. In this embodiment, the cable 410 enters via an edge 203, here (end) edge 203*a*, of the secondary part 200 and exits via the functional part 210 at the first side 201. A gasket 240 is comprised by the functional part. Note that the functional part extends from the first side 201. The secondary part 200 and gasket 240 may e.g. be a two-component injection molding product. Further, the schematical drawing 2*a* shows that at the inlet 220 of the secondary part, the cable 410 and the secondary part 200 comprises an overmolding 222. Secondary part 200 comprises said first side 201, and a second side 202 and an edge 203, with (an) end edge(s) 203*a* and (a) side edge(s) 203*b*.

In the enlarged detailed portion of FIG. 2 it is shown that the multi-part cable module comprises in the secondary part a duct 460 for passing through the cable, said duct comprising a curvature 450, said curvature having an angle ß in the range of 45° to 180°, in the figure 90°. This curvature anchors the cable in the duct, and counteracts slipping of the cable inside the duct when the cable is pulled at. At least part of the cable is integrated in the secondary part. Especially, at the inlet of the secondary part, the cable and the secondary part comprise an overmolding. In particular slipping is counteracted when the cable snugly fits in the duct, or is presence in the duct under permanent compressive force.

In relation to FIG. 1 click-stop elements 161 were indicated, which are part first click-stop elements. The counter part of these click-stop elements 161 at the primary part 100 are the click-stop elements 261 schematically depicted in FIG. 2*a* at the secondary part 200. Together, these click-stop elements 161,261 form the first click-stop elements 161,261 (for a click-stop connection when the secondary part 200 is engagingly received by the primary part 100).

Figure 2B:
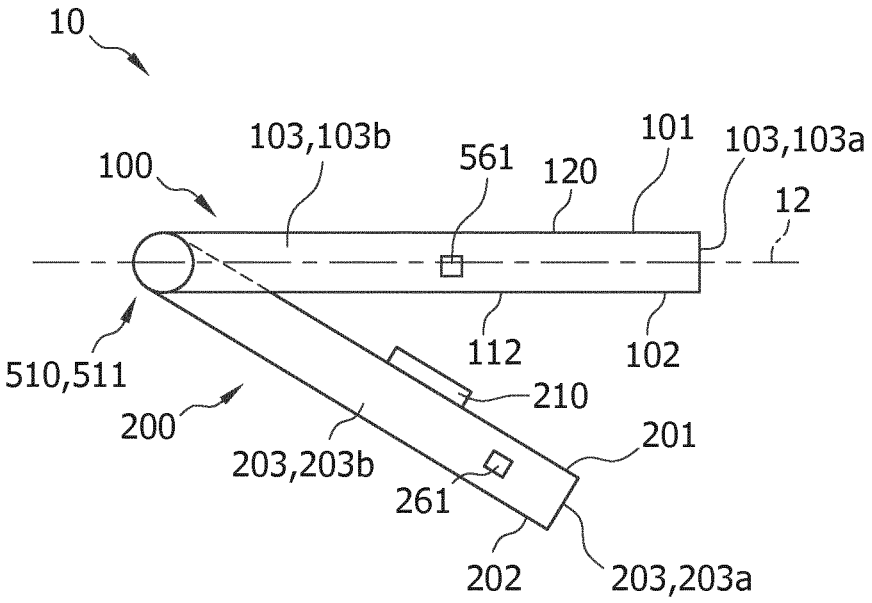
Figure 2C:
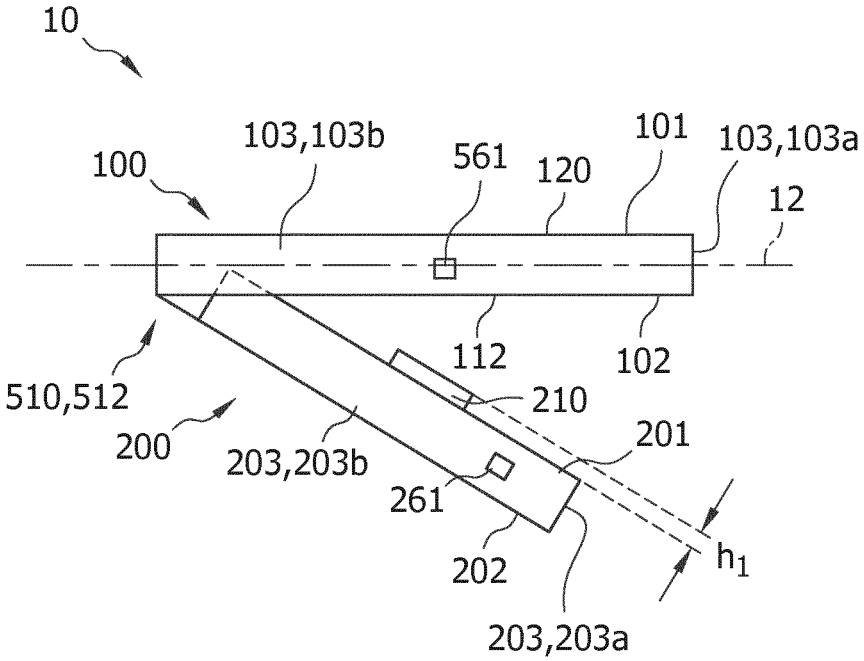

FIGS. 2*b* and 2*c* schematically depict some configurations of the multi-part cable module 10, wherein in both embodiments the primary part 100 and secondary part 200 are coupled via a coupling 510. Here, the primary part 100 and secondary part 200 are hingingly coupled, in FIG. 2*b* this coupling is via an axis, to provide a rotational coupling 511 of the elements, and in FIG. 2*c* this coupling is via a film hinge 512. As indicated above, references 120 and 112 indicate openings in the primary part 100 at the first primary part side 101 and second primary part side 102, respectively, here providing the through cavity.

Reference h1 indicates the height of the functional part 210 relative to the first primary part side 101. Height h1 may e.g. be in the range of 0.5-20 mm, such as 1-15 mm, like 1.5-10 mm.

In relation to FIG. 1, click-stop elements 361 were indicated, which are part of the second click-stop elements. The counter part of these click-stop elements at the primary part 100 are the click-stop elements 561 schematically depicted in FIGS. 2*b*-2*c* at the primary part 100 (at the edge 103, i.e. side edge 103*b*). These click-stop elements 361,561 form the second click-stop elements 361,561 (for a click-stop connection when the multi-part cable module 10 and support 30 are (configured) associated in the male-female association).

The assembling and connecting method e.g. include:

Slide primary part in the groove of the base plate till the part is blocked by a stopper which is integrated in primary part.

Rotate secondary part which can be integrated with primary part. Integration options are; a film hinges or a click and rotation mechanism which can hold both parts together.

During the rotation the cable inside secondary part, will enter the top surface location of the base plate with PCBA and connector.

In the end position of the rotation, the plastic secondary part will click that it can't rotate.

A plastic rim which is integrated in secondary part, will hold the plastic parts inside a cut out of the base plate to prevent a sliding movement outwards.

The connected surfaces of the base plate and secondary part can clamp a gasket. Secondary part has e.g. an IP66 rating with the cutout for the base plate.

The clamping force to get e.g. an IP66 rating needed for lifetime after installation the module inside the luminaire can hold by the click mechanism or the surface pressure of the luminaire.

Figure 3A:
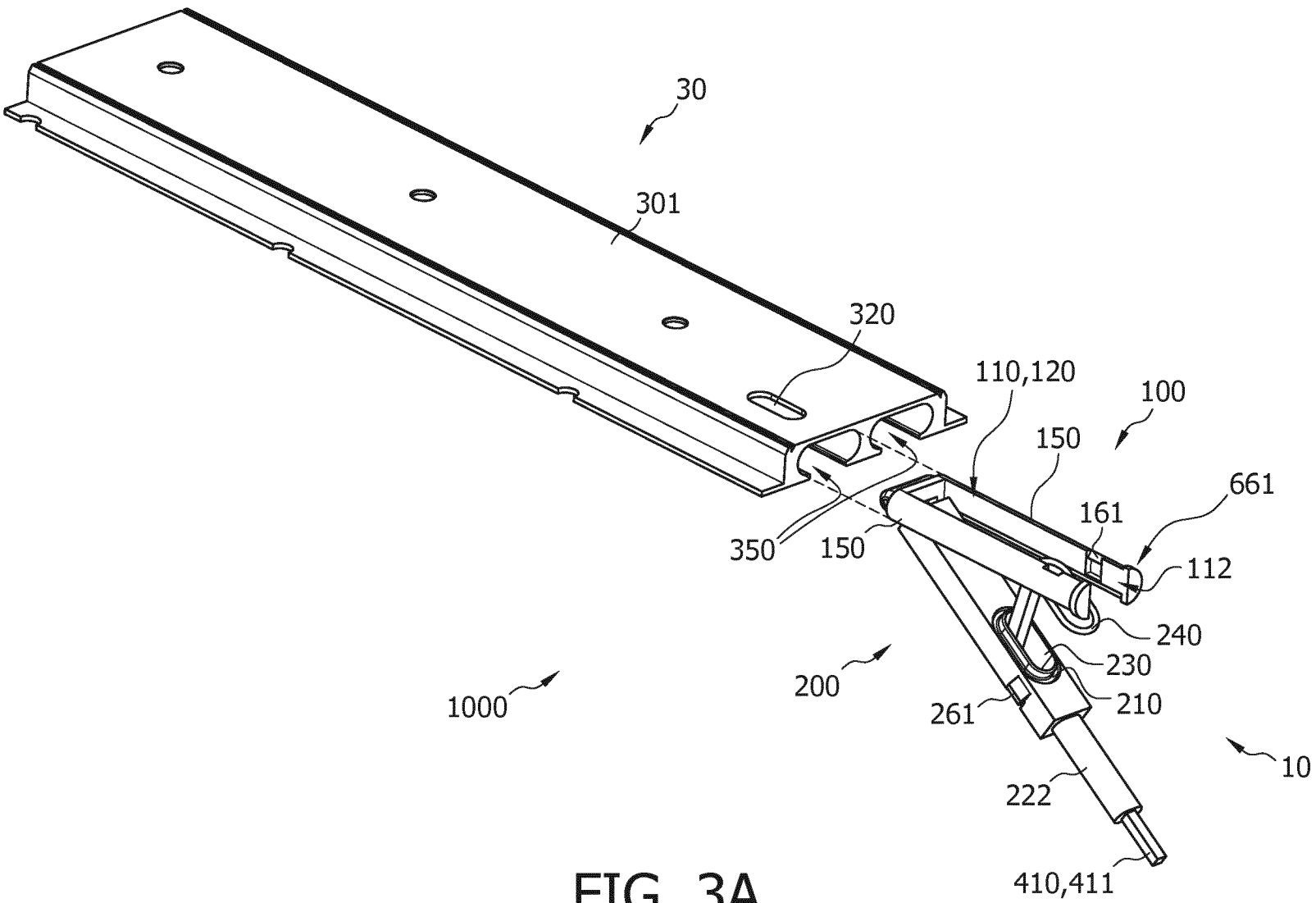
FIGS. 3*a*-3*c* schematically depict some further aspects and variants.

FIG. 3*a* schematically depicts again a kit of parts 1000. Here, the primary part 100 and secondary part 200 are hingingly coupled. First, the multi-part cable module 10 may be slided to the receiver rail element 350, with the multi-part cable module in opened position. When the male-female association with the receiver rail element 350 of the support 30 is obtained (see also the (click-)stop element 661), the cable 410 that exits the multi-part cable module 10 at the functional part 210 can be arranged through the support opening 320. Thereafter, the secondary part 200 can be rotated to be received by the cavity 110 until the secondary part 200 is fully engagingly received by the primary part 100 (see also the click-stop element 161,261). Reference 301 indicates a support face. The functional element 210 may not only extend into the support inlet 320 but may even protrude beyond the support face 301. The edge of the primary part 100 comprises an access for the cable 410: an opening at the edge (for receipt of the cable), here an end edge (see also FIG. 1).

Figure 3B:
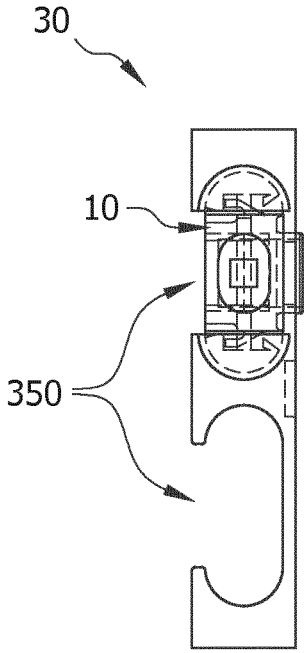
Figure 3C:
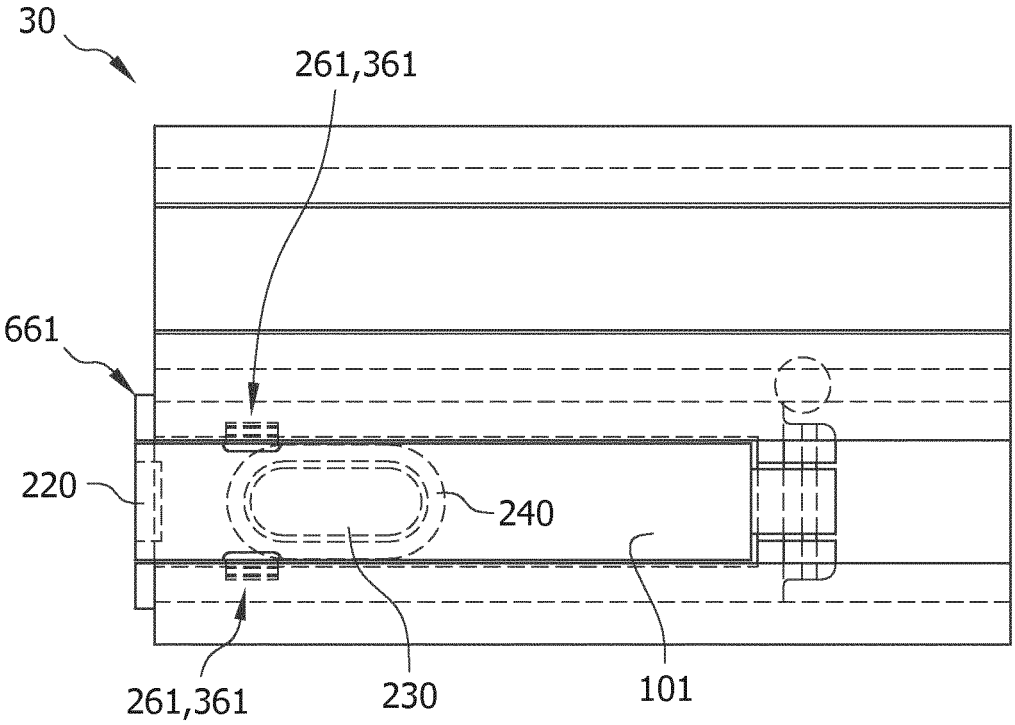

FIGS. 3*b* and 3*c* schematically depict cross-sectional views of the multi-part cable module 10 in the male-female association with the support 30. Here, the support 30 by way of example comprises two receiver rail elements 350 for e.g. receiving two different modules.

Figure 4:
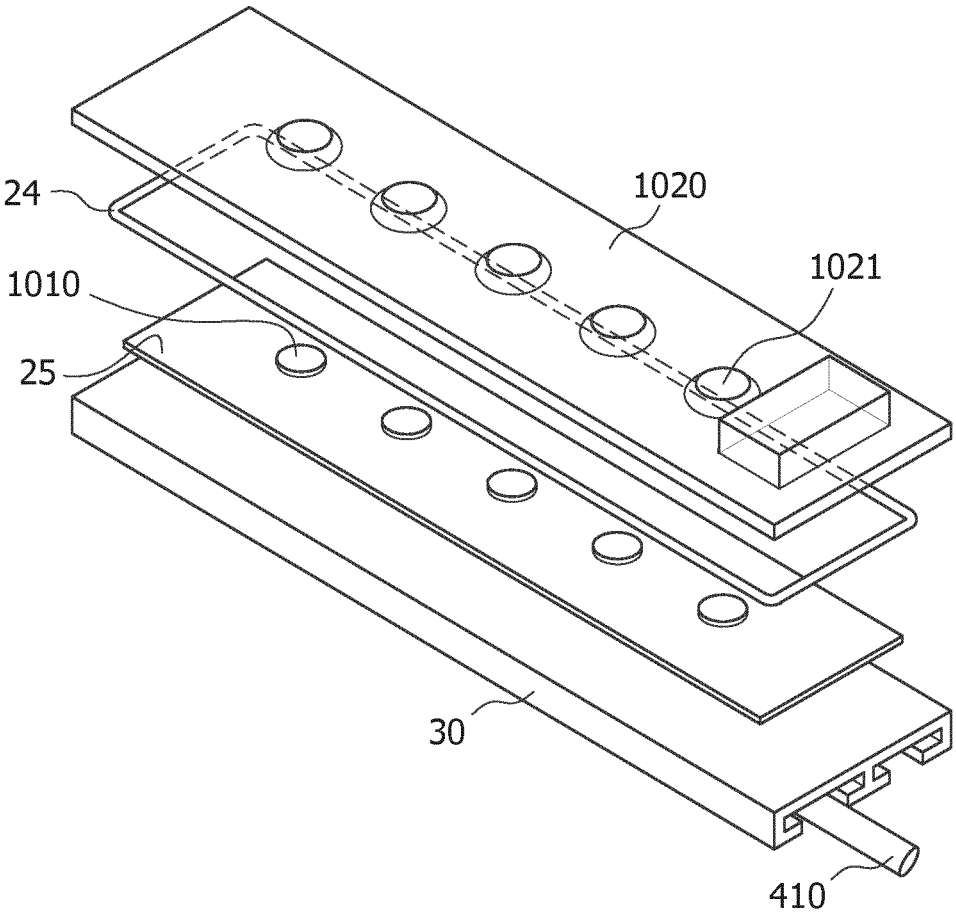
FIG. 4 schematically depicts a lighting device.

FIG. 4 schematically depicts a lighting device 1 comprising a light source 1010 functionally coupled to a support 30 and a closure 1020. Here, a plurality of light sources 1010 are depicted. Reference 25 indicates a PCB with the plurality of light sources. Reference 24 indicates a gasket to seal the closure 1020. Here, the closure is a lens plate with lenses 1021 for the light sources. The multi-part cable module is integrated in the support 30, and is not visible in this schematic drawing.

The term "substantially" herein, such as in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein. Likewise this may apply to terms like "primary" and "secondary".

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A multi-part cable module for association with a receiver rail element of a support, the multi-part cable module comprising a primary part and a secondary part, wherein the primary part is configured to engagingly receive the secondary part, wherein the primary part comprises (a) a cavity to receive at least part of the secondary part, and (b) a primary part opening to provide access to at least part of a functional part of the secondary part when the secondary part is engagingly received by the primary part, and wherein the primary part further comprises (c) a primary part rail element configured for a male-female association with the receiver rail element of the support;

the secondary part comprises (a) an inlet for receiving a cable, and (b) said functional part, wherein the functional part comprises an outlet for said cable, wherein the functional part further comprises a gasket perimetrically surrounding said outlet, and wherein the secondary part and gasket are an injection molding product, and wherein the primary part comprises a first primary part side, wherein the secondary part comprises a first secondary part side, wherein at least part of the functional part extends from said first secondary part side, and wherein at least part of the functional part is configured to extend also from the first primary part side when the secondary part is engagingly received by the primary part.

2. The multi-part cable module according to claim 1, wherein the secondary part and gasket are a plastic or a two-component injection molding product.

3. The multi-part cable module according to claim 1, wherein the secondary part comprises a duct ( . . . ) for passing through the cable, said duct comprising a curvature, said curvature having an angle ß in the range of 45° to 180°, preferably from 60° to 120°.

4. The multi-part cable module according to claim 1, wherein the cable is configured anchored in the multi-part cable module, and wherein the cable comprises an electrical cable, wherein at least part of the cable is integrated in the secondary part, and wherein at the inlet of the secondary part the cable and the secondary part comprise an overmolding.

5. The multi-part cable module according to claim 1, wherein the primary part and the secondary part are hingingly coupled with a film hinge.

6. The multi-part cable module according to claim 1, wherein the primary part and the secondary part are configured such that when the secondary part is engagingly received by the primary part, the secondary part cannot move relative to the primary part.

7. The multi-part cable module according to claim 1, wherein the primary part and the secondary part comprise first click-stop elements for a click-stop connection when the secondary part is engagingly received by the primary part.

8. A kit of parts comprising (a) a support comprising a rail element and (b) the multi-part cable module according to claim 1, wherein the multi-part cable module and support are associable in a male-female association by said primary part rail element of the primary part and said receiver rail element of the support; and the support further comprises a support opening to provide access to at least part of said functional part of the secondary part when the secondary part is engagingly received by the primary part.

9. The kit of parts according to claim 8, wherein (a) one or more of the primary part and the secondary part and (b) the support comprise second click-stop elements for a click-stop connection when the multi-part cable module and support are associated in the male-female association.

10. The kit of parts according to claim 8, further comprising a light source and a closure, for functionally coupling with said support to provide a lighting device, wherein the light source comprises a light emitting diode (LED).

11. A method for providing a lighting device comprising:

providing (a) a light source functionally coupled to a support, (b) a closure, and (c) a multi-part cable module according to claim 1 with an electrical cable; wherein said support comprises a receiver rail element and a support opening to provide access to at least part of said functional part of the secondary part when the secondary part is engagingly received by the primary part; and executing the following actions:

configuring the primary part rail element with the receiver rail element of the support into a male-female association, and arranging at least part of the secondary part into the cavity of the primary part such that the secondary part is engagingly received by the primary part;

functionally coupling the light source with the electrical cable; and functionally coupling the support and the closure to enclose at least part of the light source.

12. A lighting device comprising (a) a light source functionally coupled to a support and (b) a closure, wherein the lighting device further comprises a multi-part cable module according to claim 1 with an electrical cable, wherein:

the closure encloses at least part of the light source;

said support comprises a receiver rail element and a support opening to provide access to at least part of said functional part of the secondary part;

the primary part rail element is associated with the receiver rail element of the support into a male-female association; and the secondary part is engagingly received by the primary part.

13. The lighting device according to claim 12, wherein at least part of the functional part extends from the first secondary part side into the support opening, and wherein at least part of the cable is integrated in the secondary part, wherein at the inlet of the secondary part the cable and the secondary part comprise an overmolding.

14. Use of a multi-part cable module according to claim 1 for providing a lighting device with ingress protection IP55 or higher.

* * * * *